US006475417B2

(12) United States Patent
Nesbitt et al.

(10) Patent No.: US 6,475,417 B2
(45) **Date of Patent: *Nov. 5, 2002**

(54) GOLF BALL

(75) Inventors: R. Dennis Nesbitt, Westfield, MA (US); Michael J. Sullivan, Chicopee, MA (US); Terence Melvin, Ormon Beach, FL (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 130 days.

This patent is subject to a terminal disclaimer.

(21) Appl. No.: 09/746,824

(22) Filed: Dec. 22, 2000

(65) Prior Publication Data

US 2002/0010035 A1 Jan. 24, 2002

Related U.S. Application Data

(62) Division of application No. 09/324,390, filed on Jun. 3, 1999, which is a continuation-in-part of application No. 09/108,797, filed on Jul. 2, 1998, now Pat. No. 6,113,831, which is a division of application No. 08/729,725, filed on Oct. 7, 1996, now Pat. No. 5,976,443, which is a division of application No. 08/551,255, filed on Oct. 31, 1995, now Pat. No. 5,733,206.

(51) Int. Cl.[7] ..... B29C 43/02

(52) U.S. Cl. ..... 264/134; 264/320; 264/327; 264/322; 264/279.1; 264/325; 264/232; 264/340

(58) Field of Search ..... 264/134, 320, 264/327, 322, 279.1, 325, 232, 340

(56) References Cited

U.S. PATENT DOCUMENTS 684,050 A 10/1901 Falconnet et al.
2,618,812 A 11/1952 Hulswit, Jr. et al.
2,642,627 A 6/1953 Mann et al.
3,421,766 A 1/1969 Chimmel et al.
4,570,937 A 2/1986 Yamada
4,650,193 A 3/1987 Molitor et al.
4,838,556 A 6/1989 Sullivan
4,844,471 A 7/1989 Terence et al.
4,852,844 A 8/1989 Sullivan
4,884,814 A 12/1989 Sullivan
4,911,451 A 3/1990 Sullivan et al.
4,986,545 A 1/1991 Sullivan
5,033,748 A 7/1991 Ebisuno
5,068,151 A 11/1991 Nakamura
5,072,944 A 12/1991 Nakahara et al.
5,098,105 A 3/1992 Sullivan
5,184,828 A 2/1993 Kim et al.
5,314,187 A 5/1994 Proudfit
5,403,010 A 4/1995 Yabuki et al.
5,490,674 A 2/1996 Hamada et al.
5,555,098 A 9/1996 Parluski
5,725,442 A 3/1998 Higuchi et al.
5,733,205 A 3/1998 Higuchi et al.
5,733,206 A 3/1998 Nesbitt et al.
5,772,531 A 6/1998 Ohsumi et al.
5,816,940 A 10/1998 Hayashi et al.
5,816,942 A 10/1998 Hayashi et al.

*Primary Examiner*—Jan H. Silbaugh
*Assistant Examiner*—Edmund H. Lee

(57) ABSTRACT

The present invention is directed to a golf ball comprising a solid core component that includes a relatively hard central portion and a relatively soft skin portion surrounding the central portion. Various preferred embodiment golf balls are disclosed utilizing this core configuration. A golf ball comprising the noted core component having a wound layer disposed about the core skin portion is described. Another preferred embodiment relates to the use of the noted core component having a multi-layer cover assembly surrounding the core. Various methods for producing such golf ball core components are disclosed.

12 Claims, 2 Drawing Sheets

GOLF BALL

CROSS REFERENCES TO RELATED APPLICATIONS

This is a divisional application of U.S. Ser. No. 09/324,390 filed Jun. 3, 1999, which is a continuation-in-part application of U.S. Ser. No. 09/108,797 filed Jul. 2, 1998, now U.S. Pat. No. 6,113,831, which is a divisional of U.S. Ser. No. 08/729,725 filed Oct. 7, 1996, now U.S. Pat. No. 5,976,443, which is a divisional of U.S. Ser. No. 08/551,255 filed Oct. 31, 1995, now issued as U.S. Pat. No. 5,733,206.

FIELD OF THE INVENTION

The present invention is directed to a golf ball core component that includes a central portion and a relatively soft skin portion that surrounds the central portion. Various preferred embodiment golf balls are described that utilize such a core component and further include one or more interior wound layers and/or multi-layer covers.

BACKGROUND OF THE INVENTION

Sound and feel are two qualities of golf balls which are typically judged subjectively. For the most part, however, soft sound ("click") and soft feel (i.e., low vibrations) are golf ball qualities desired by many golfers. If a soft feeling ball is misfit, the adverse sting felt in a golfer's hands is not as great as if a harder feeling ball is hit improperly. A soft sounding ball has a soft low pitch when hit with any club, but particularly off a putter.

One way to achieve a soft sound and feel is to provide a softened layer between the core and the cover. The prior art teaches development of a three piece ball or a multi-layer cover. However, adding additional layers is costly and can sometimes lead to non-uniform layers.

U.S. Pat. No. 4,650,193 to Molitor et al. describes a two-piece golf ball comprising a core and a cover. The core has a central portion of a cross-linked, hard, resilient material and a soft, deformable outer layer. The cover is a conventional cover. The soft, deformable outer layer of the core is integral with the core. It is formed by treating a slug of an elastomeric material with a cure altering agent, namely elemental powdered sulfur, so that a thin layer of sulfur coats the surface. The sulfur-coated slug is then cured in a molding cavity at temperatures greater than 290° F., e.g., 325° F., for 10–20 minutes, depending on core temperature.

According to the '193 patent, sulfur on the surface of the slug penetrates a surface layer to a depth of about 1/16 inch during curing. Wherever the core is exposed to sulfur, the conventional peroxide cure is altered, resulting in an amorphous soft outer layer. The portion of the core that is not touched by the sulfur cures normally and becomes relatively crystalline. The final result is a spherical core having a hardness gradient in its surface layers.

The present inventors seek to achieve somewhat of a similar effect using methods which do not require the addition of elemental sulfur to modify and soften the core surface such that the cure on the core surface is retarded. At the same time, the inventors seek to maintain the parameters of resilience and hardness of the finished ball at desired levels.

Resilience is determined by the coefficient of restitution (C.O.R.), the constant "e", which is the ratio of the relative velocity of two elastic spheres after direct impact to that before impact, or more generally, the ratio of the outgoing velocity to incoming velocity of a rebounding ball. As a result, the coefficient of restitution (i.e., "e") can vary from zero to one, with one being equivalent to an elastic collision and zero being equivalent to an inelastic collision. Hardness is determined as the deformation (i.e., Riehle compression) of the ball under a fixed load of 200 pounds applied across the ball's diameter (i.e., the lower the compression value, the harder the material).

Resilience (C.O.R.), along with additional factors such as clubhead speed, angle of trajectory, and ball configuration (i.e., dimple pattern), generally determines the distance a ball will travel when hit. Since clubhead speed and the angle of trajectory are not factors easily controllable, particularly by golf ball manufacturers, the factors of concern among manufacturers are the coefficient of restitution (C.O.R.) and the surface configuration of the ball.

In this regard, the coefficient of restitution of a golf ball is generally measured by propelling a ball at a given speed against a hard surface and measuring the ball's incoming and outgoing velocity electronically. The coefficient of restitution must be carefully controlled in all commercial golf balls in order for the ball to be within the specifications regulated by the United States Golfers Association (U.S.G.A.).

Along this line, the U.S.G.A. standards indicate that a "regulation" ball cannot have an initial velocity (i.e., the speed off the club) exceeding 255 feet per second (250 feet per second with a 2% tolerance). Since the coefficient of restitution of a ball is related to the ball's initial velocity (i.e., as the C.O.R. of a ball is increased, the ball's initial velocity will also increase), it is highly desirable to produce a ball having a sufficiently high coefficient of restitution to closely approach the U.S.G.A. limit on initial velocity, while having an ample degree of hardness (i.e., impact resistance) to produce enhanced durability.

The coefficient of restitution (C.O.R.) in solid core balls is a function of the composition of the molded core and of the cover. In balls containing a wound core (i.e., balls comprising a liquid or solid center, elastic windings, and a cover), the coefficient of restitution is a function of not only the composition of the center and cover, but also the composition and tension of the elastomeric windings.

An object of this invention is to develop a method for improving the sound and feel of a golf ball without adversely affecting the resilience or coefficient of restitution of the ball. The method does not require the addition of sulfur based chemicals to an uncured slug, in order to minimize the steps involved. In addition, the softer golf ball produces the playability characteristics desired by the more skilled golfer. It also enhances durability characteristics, as the outer skin is flexible and resists crack propagation.

These and other objects and features of the invention will be apparent from the following summary and description of the invention and from the claims.

SUMMARY OF THE INVENTION

The present invention provides, in one aspect, a golf ball comprising a core component having a central portion with a Shore C hardness of from about 50 to about 90, and an integral skin portion disposed on the central portion, the skin having a Shore C hardness of from about 30 to about 70. The golf ball further includes a cover component disposed on the core component and generally surrounding the core component. The cover component may consist of single or multiple layers.

In another aspect, the present invention provides a golf ball comprising a core component having a central portion and a skin portion disposed about the central portion. The central portion is harder than the skin portion, and both central and skin portions are formed in-situ from the same material or different material. The golf ball may further include a wound layer and a cover component disposed about the wound layer. The cover component may consist of one or more layers.

In yet another aspect, the present invention provides a golf ball comprising a core component having a central portion and a skin portion disposed about the central portion. The hardness of the central portion is at least 20 Shore C units greater than the hardness of the skin portion. The ball further comprises a wound layer disposed about the core component, and a cover component surrounding the wound layer. The cover component may consist of single or multiple layers.

In a further aspect, the present invention provides a method for producing a golf ball core component having a central portion and a skin portion disposed on the central portion, such that the skin portion is softer than the central portion. The method comprises depositing a slug of polymeric material capable of undergoing an exothermic curing reaction, in a molding chamber. The slug is then subjected to curing conditions to cause the temperature within the interior of the molding chamber to increase. The molding chamber is cooled to thereby cause the temperature at the surface of the slug to be less than the temperature within the interior of the slug. This results in a golf ball core having a central portion and a softer skin portion. The core is then enclosed by one or more cover layers. Optionally, a wound layer can be disposed on the core under the cover layer(s). The golf ball produced by this method is also included in the present invention.

In another aspect, the present invention provides a method for producing a golf ball core component having a central portion and a skin portion disposed on the central portion such that the skin portion is softer than the central portion. In this aspect, the method includes exposing a slug of polymeric material to water such that the slug absorbs water. The slug is then deposited within a molding chamber of a molding apparatus and the polymeric material is cured. As a result of the water absorbed about the surface of the polymeric slug, a golf ball core component having the central portion and a softer skin portion surrounding the central portion is produced. The core is then encapsulated by a wound layer and/or one or more cover layers.

In another aspect, the present invention provides a method for producing a golf ball core component having a central portion and a skin portion surrounding the central portion. The method involves depositing a cross-linking retardant agent on the surface of a polymeric slug. The slug is placed within a molding chamber and the slug is then cured. The resulting golf ball core component includes a relatively soft skin that surrounds a harder central portion. The core is subsequently enclosed by a wound thread layer and/or one or more cover layers.

These and other advantages of the invention will become apparent from the detailed description provided below.

BRIEF DESCRIPTION OF THE DRAWINGS

The present invention is further described and illustrated in the accompanying drawings which form a part hereof.

DETAILED DESCRIPTION OF THE PREFERRED EMBODIMENTS

Figure 1:
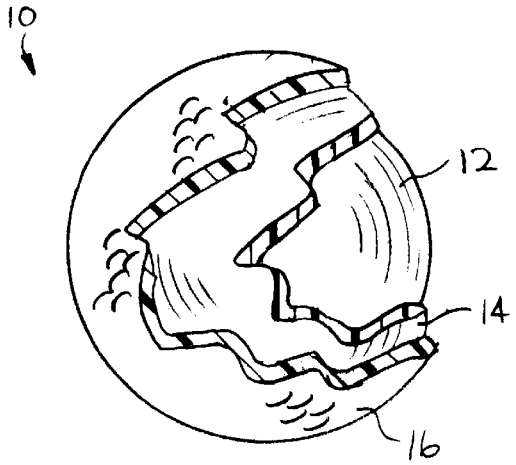
FIG. 1 is a partial sectional view of a preferred embodiment golf ball in accordance with the present invention, the view illustrating the various regions and configuration of the golf ball.

The present invention is directed to golf balls having improved core, cover, and/or wound layer construction and several methods for improving such constructions. Broadly, the golf ball core of the invention comprises a spherical central portion which is hard and resilient. The central portion of the core may be formed by molding core formulations, and preferably those described herein. A soft, relatively easily deformable outer layer or skin is embodied or integral with the central portion. The core is enclosed by an optional wound layer and/or one or more cover layers, as described herein.

Solid Cores and Soft Skin

Solid cores are typically compression or injection molded from a slug of uncured elastomer composition comprising at least polybutadiene and a metal salt of an alpha, beta, ethylenically unsaturated monocarboxylic acid.

The core compositions of the present invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers may also be utilized. Most preferably, cis-polybutadiene having a weight average molecular weight of from about 100,000 to about 500,000 is employed. Along this line, it has been found that the high cis-polybutadiene manufactured and sold by Shell Chemical Co., Houston, Tex., under the trade name Cariflex BR-1220 is particularly well suited.

The unsaturated carboxylic acid component of the core composition (a co-cross-linking agent) is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 20 to about 50, and preferably from about 25 to about 35 parts by weight of the carboxylic acid salt, such as zinc diacrylate, is included in the core composition. The unsaturated carboxylic acids and metal salts thereof are generally soluble in the elastomeric base, or are readily dispersible.

The free radical initiator included in the core composition is any known polymerization initiator (a co-cross-linking agent) which decomposes during the cure cycle. The term "free radical initiator" as used herein refers to a chemical which, when added to a mixture of the elastomeric blend and a metal salt of an unsaturated, carboxylic acid, promotes cross-linking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 parts by weight, and preferably in amounts of from about 0.3 to about 3.0 parts by weight per each 100 parts of elastomer.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercially available peroxides are Luperco 230 or 231 XL, a peroxyketal manufactured and sold by Atochem, Lucidol Division, Buffalo, N.Y., and Trigonox 17/40 or 29/40, sold by Akzo Chemie America, Chicago, Ill. The one hour half life of Luperco 231 XL and Trigonox 29/40 is about 112° C., and the one hour half life of Luperco 230 XL and Trigonox 17/40 is about 129° C. Luperco 230 XL and Trigonox 17/40 are n-butyl4, 4-bis (t-butylperoxy) valerate, and Luperco 231 XL and Trigonox 29/40 are 1, 1-di(t-butylperoxy) 3,3,5-trimethyl cyclohexane.

The core compositions of the present invention may additionally contain any other suitable and compatible modifying ingredients including, but not limited to, metal oxides, fatty acids, and diisocyanates. For example, Papi 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger.

Various activators may also be included in the compositions of the present invention. For example, zinc oxide and/or magnesium oxide are activators for the polybutadiene. The activator can range from about 2 to about 30 parts by weight per 100 parts by weight of the rubbers (phr) component.

Moreover, filler-reinforcement agents may be added to the composition of the present invention, such as polypropylene powder. Since the specific gravity of polypropylene powder is very low, and when compounded, the polypropylene powder produces a lighter molded core, large amounts of higher gravity fillers may be added. Additional benefits may be obtained by the incorporation of relatively large amounts of higher specific gravity, inexpensive mineral fillers such as calcium carbonate. Such fillers as are incorporated into the core compositions should be in finely divided form, as for example, in a size generally less than about 30 mesh and preferably less than about 100 mesh U.S. standard size. The amount of additional filler included in the core composition is primarily dictated by weight restrictions and preferably is included in amounts of from about 10 to about 100 parts by weight per 100 parts rubber.

The preferred fillers are relatively inexpensive and heavy and serve to lower the cost of the ball and to increase the weight of the ball to closely approach the U.S.G.A. weight limit of 1.620 ounces. Exemplary fillers include mineral fillers such as limestone, silica, mica, barytes, calcium carbonate, or clays. Limestone is ground calcium/magnesium carbonate and is used because it is an inexpensive, heavy filler. Metal oxide or other fillers, such as barytes may also be included to increase core weight so that the finished ball more closely approaches the U.S.G.A. upper weight limit of 1.620 ounces.

Ground flash filler may be incorporated and is preferably 20 mesh ground up center stock from the excess flash from compression molding. It lowers the cost and may increase the hardness of the ball.

Fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. When included in the core compositions, the fatty acid component is present in amounts of from about 1 to about 15, and preferably in amounts from about 2 to about 5 parts by weight based on 100 parts rubber (elastomer).

It is preferred that the core compositions include stearic acid as the fatty acid adjunct in an amount of from about 2 to about 5 parts by weight per 100 parts of rubber.

Diisocyanates may also be optionally included in the core compositions. When utilized, the diioscyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbonates set forth in U.S. Pat. No. 4,852,884 may also be incorporated into the polybutadiene compositions of the core. All of these noted patents are herein incorporated by reference. The specific types and amounts of such additives are set forth in the above identified patents, and are incorporated herein by reference.

The golf ball core compositions of the invention are generally comprised of the addition of about 1 to about 100 parts by weight of particulate polypropylene resin (preferably about 10 to about 100 parts by weight polypropylene powder resin) to core compositions comprised of 100 parts by weight of a base elastomer (or rubber) selected from polybutadiene and mixtures of polybutadiene with other elastomers, 10 to 50 parts by weight of at least one metallic salt of an unsaturated carboxylic acid, and 1 to 10 parts by weight of a free radical initiator. More preferably, the particulate polypropylene resin utilized in the present invention comprises from about 20 to about 40 parts by weight of a polypropylene powder resin such as that trademarked and sold by Amoco Chemical Co. under the designation "6400 P", "7000 P" and "7200 P". The ratios of the ingredients may vary and depending upon the particular characteristics desired.

As indicated above, additional suitable and compatible modifying agents such as fatty acids, and secondary additives such as Pecan shell flour, ground flash (i.e. grindings from previously manufactured cores of substantially identical construction), barium sulfate, zinc oxide, etc. may be added to the core compositions to increase the weight of the ball as necessary in order to have the ball reach or closely approach the U.S.G.A. weight limit of 1.620 ounces.

In producing golf ball cores utilizing the present compositions, the ingredients may be intimately mixed using, for example, two roll mills or a Banbury mixer until the composition is uniform, usually over a period of from about 5 to about 20 minutes. The sequence of addition of components is not critical. A preferred blending sequence is as follows.

The elastomer, polypropylene powder resin, fillers, zinc salt, metal oxide, fatty acid, and the metallic dithiocarbamate (if desired), surfactant (if desired), and tin difatty acid (if desired), are blended for about 7 minutes in an internal mixer such as a Banbury mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is then rolled into a "pig" placed in a Barwell preformer and slugs are produced. The mixing is desirably conducted in such a manner that the composition does not reach incipient polymerization temperatures during the blending of the various components.

The conventional slugs or cores prepared substantially as described above are then treated using novel techniques described herein, so that the outer 1/32 inch to 1/4 inch periphery of each slug or core is softened. The softened periphery is referred to as a soft skin. This skin is embodied in or integral with the preexisting core or slug. It is not the result of adding a layer. Preferably, the skin is formed in-situ with the core. The slug itself is treated as described herein to soften the outermost periphery in order to achieve a golf ball which, when a wound thread layer and/or one or more cover layers is placed over the soft-skinned core, has superior sound and feel.

Sound and feel are subjective parameters. However, in general, a soft sound has a softer, lower pitch sound when hit with any club but particularly off a putter. The same applies for a soft feel. A hard feeling ball will sting in the hands when hit with a driver, particularly when hit improperly. A soft feeling putt will be barely audible.

The present inventors have developed several novel methods for achieving a soft skin integral with or embodied in a polymeric core by controlling, at least in part, the molding conditions of the slug. More specifically, the exothermic reaction in molding the core is regulated such that the interior of the resulting core is hard due to higher exothermic temperatures, and the outer skin is soft because of lower outside mold temperatures. Preferably, curing of the core is conducted to cause the temperature within the interior of the core, e.g. slug, to increase. Most preferably, the temperature within the interior of the core exceeds 350° F. during cure. It is also desirable that the temperature of the outer surface of the core, e.g. the slug, be controlled so that the temperature of the outer surface of the slug is less than the interior temperature of the slug. Preferably, the mold chamber is cooled so that the temperature at the surface of the slug is less than 280° F. More preferably, the surface temperature is 230° F. to 280° F.

For instance, the exothermic method involves placing a slug or preform weighing approximately 44 grams into a cold 1.600 inch molding cavity (i.e. a four cavity lab mold). The four cavity compression mold is closed using 500 psi hydraulic ram pressure. The steam temperature is set at a predetermined temperature and the steam is turned on for a predetermined period of time. As the curing time progresses, the temperature overrides the set point and reaches a mold temperature at the end of the predetermined time. The steam is then turned off and cold water is applied for approximately 15 minutes. The mold is opened and centers are removed. The molded cores have a soft skin which is embodied with the central core.

Another method for forming a soft skin on a preform or slug involves first immersing the slug into water. Water has a deleterious effect on the properties of conventional core formulations. Water, even in very small quantities, will soften the compression of the core by retarding cross-linking on the core surface during molding. A slug can be immersed into water prior to molding the core to absorb water about its surface periphery and create a soft skin on the outside of the core. Immersion of slugs in water with a surfactant (to increase wetting and penetration) for a period of approximately two hours softens the core surface. A suitable surfactant is one which is soluble in water and which acts to lower the surface tension. An example of a surfactant which may be used in the present method is one such as Fluorad FC-120 made by the 3M Company. It is contemplated that a wide array of other surfactants could be utilized.

In the alternative, the cure on the core surface can be chemically retarded by coating the outside of the preform or slug with a chemical that retards the cure or cross-linking of a peroxide system prior to molding the center. Coating with elemental sulfur was described in U.S. Pat. No. 4,650,193, herein incorporated by reference. Other chemicals which can be used for retarding cross-linking, i.e. cross-linking retardant agents, during molding include sulphur bearing accelerators for rubber vulcanization such as Altax (benzothiazyl disulfide), Captax (2-mercaptobenzothiazole) manufactured by R. T. Vanderbilt Co. Inc., Norwalk, Conn., and antioxidant chemicals such as Aqerite White (dibetanaphthyl-p-phenylenediamine) from R. T. Vanderbilt and Irganox 1520 (2, 4-Bis [Octylithio] methyl)-o-cresol from Ciba-geigey, Hawthorne, N.Y.

In all of the techniques described herein, the softened outer skin preferably has the same, or a similar composition, as the underlying material. However, it is to be noted that if the outer skin is softer than the inner portion as a result of addition of some agent, such as sulfur, sulfur-bearing chemicals, antioxidants, water, or if the extent of crosslinking is reduced by controlling the curing conditions, then the resulting outer skin would exhibit a chemical composition that is different, in at least some respects, than the inner core composition.

The preferred embodiment cores, and particularly those produced according to the previously described methods, preferably have a diameter in a range of about 1.480 inches to 1.600 inches, and most preferably from about 1.500 inches to 1.580 inches. The resulting skin thickness is in a range of about 1/32 of an inch to 1/4 inch, and preferably 1/16 inch to 1/8 inch.

The resulting central core hardness is in the Shore C range of 50–90, and preferably 60–80 Shore C. As for the skin, its hardness is in the range of 30–70 Shore C and preferably 50–60 Shore C. Preferably, the hardness of the core is at least 20 Shore C units greater than the hardness of the skin.

After molding, the core is removed from the mold and the surface thereof, and preferably treated to facilitate adhesion thereof to the covering materials. Surface treatment can be effected by any of the several techniques known in the art, such as corona discharge, ozone treatment, sand blasting, and the like. Preferably, surface treatment is effected by grinding with an abrasive wheel.

Wound Cores

In addition to using solid cores, wound cores may also be utilized in the golf balls of the present invention. The term "wound core" includes a configuration of a core component, as described above, and a wound layer disposed on or surrounding the core component. The wound layer is preferably disposed upon the previously described soft skin of the core component. Such wound cores include a generally spherical core component and a rubber thread layer, or windings, enclosing the outer surface, i.e. the soft skin, of the core component.

In this regard, the core component of the wound core may utilize a solid center. The solid center may comprise a molded polybutadiene rubber sphere, as previously described.

The center core component, when utilized in a wound core, generally is from 1 to 1.5 inches in diameter, and preferably 1.0625 to 1.42 inches. The center core generally has a weight of 15 grams to 36 grams, and preferably 16.5 to 30 grams.

The wound core is formed by winding conventional thread rubber around the outer periphery of the core component, and specifically, about the soft skin portion of the core component. The thread rubber may include, for example, a material prepared by subjecting natural rubber, or a blend of natural rubber and polyisoprene rubber to vulcanization and molding. The winding process is performed under high tension to produce a threaded layer over the soft skin portion of the core component. Conventional techniques may be employed in winding the thread rubber and known compositions may be used. Although the thread rubber is not limited with respect to specific gravity, dimension and gage, it usually has a specific gravity of 0.9 to 1.1, a width of 0.047 to 0.094 inches and a gage of 0.012 to 0.026 inches.

The rubber thread layer has a radial thickness of 0.010 to 0.315 inches and is deposited about the core component to produce a wound core having an outer diameter of 1.52 to 1.63 inches. The overall weight of the wound core is 33 to 44 grams, and preferably 35 to 39 grams.

Cover

The core, or wound core, is subsequently converted into a golf ball by providing at least one layer of a covering material thereon, ranging in thickness from about 0.040 to about 0.120 inch, and preferably from about 0.055 to about 0.090 inch. The cover hardness, when measured on a Shore D scale, is in the range of 45 to 75, and preferably 50 to 70 Shore D. The cover composition preferably is made from ethylene-acrylic acid or ethylene-methacrylic acid copolymers neutralized with mono or polyvalent metals such as sodium, potassium, lithium, calcium, zinc, or magnesium. The cover may include one or more cover layers as described herein. A cover assembly comprising a first inner cover layer surrounded by a second outer cover layer is preferred.

The ionic copolymers used to produce the cover compositions may be made according to known procedures, such as those in U.S. Pat. No. 3,421,766 or British Patent No. 963,380, with neutralization effected according to procedures disclosed in Canadian Patent Nos. 674,595 and 713,631, all herein incorporated by reference, wherein the ionomer is produced by copolymerizing the olefin and carboxylic acid to produce a copolymer having the acid units randomly distributed along the polymer chain. The ionic copolymer preferably comprises one or more α-olefins and from about 9 to about 30 weight percent of α, β-ethylenically unsaturated mono- or dicarboxylic acid, the basic copolymer neutralized with metal ions to the extent desired.

Preferably, at least 18% of the carboxylic acid groups of the copolymer are neutralized by the metal ions, such as sodium, potassium, zinc, calcium, magnesium, and the like, and exist in the ionic state.

Suitable olefins for use in preparing the ionomeric resins include, but are not limited to, ethylene, propylene, butene-1, hexene-1, and the like. Unsaturated carboxylic acids include, but are not limited to, acrylic, methacrylic, ethacrylic, α-chloroacrylic, crotonic, maleic, fumaric, itaconic acids, and the like. Preferably, the ionomeric resin is a copolymer of ethylene with acrylic and/or methacrylic acid, such as those disclosed in U.S. Pat. Nos. 4,884,814; 4,911,451; 4,986,545 and 5,098,105, all of which are incorporated herein by reference.

In this regard, the ionomeric resins sold by E. I. DuPont de Nemours Company under the trademark "Surlyn®", and the ionomer resins sold by Exxon Corporation under either the trademark "Escor®" or the trade name "lotek" are examples of commercially available ionomeric resins which may be utilized in the present invention. The ionomeric resins formerly sold under the designation "Escor®" and now under the name "lotek", are very similar to those sold under the "Surlyn®" trademark in that the "lotek" ionomeric resins are available as sodium of zinc salts of poly(ethylene acrylic acid) and the "Surlyn" resins are available as zinc or sodium salts of poly(ethylene methacrylic acid). In addition various blends of "lotek" and "Surlyn®" ionomeric resins, as well as other available ionomeric resins, may be utilized in the present invention.

In a preferred embodiment of the invention, the cover comprises acrylic acid ionomer resin having the following composition set forth in Table 1:

TABLE 1

| | % weight |
|---|---|
| lotek 4000 (7030)[1] | 52.4 |
| lotek 8000 (900)[2] | 45.3 |
| Unitane 0–110[3] | 2.25 |
| Ultramarine Blue[4] | 0.0133 |
| Santonox R[5] | 0.0033 |

[1]lotek 4000 is a zinc salt of poly (ethylene acrylic acid)
[2]lotek 8000 is a sodium salt of poly (ethylene acrylic acid)
[3]Unitane 0–110 is a titanium dioxide sold by Kemira Inc., Savannah, GA.
[4]Ultramarine Blue is a pigment sold by Whitaker, Clark, and Daniels of South Painsfield, N.J.
[5]Santonox R is an antioxidant sold by Monsanto, St. Louis, MO.

As described in greater detail below, the outer cover is preferably a multi-layer cover. Such a preferred cover comprises two layers: a first or inner layer or ply and a second or outer layer or ply. The inner layer is preferably comprised of a high acid (i.e. greater than 16 weight percent acid) ionomer resin or high acid ionomer blend. Preferably, the inner layer is comprised of a blend of two or more high acid (i.e. at least 16 weight percent acid) ionomer resin neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball.

The inner layer compositions include the high acid ionomers such as those recently developed by E. I. DuPont de Nemours & Company under the trademark "Surlyn®" and by Exxon Corporation under the trademark "Escor®" or tradename "lotek", or blends thereof. Examples of compositions which may be used as the inner layer herein are set forth in detail in U.S. Pat. No. 5,688,869 incorporated herein by reference. Of course, the inner layer high acid ionomer compositions are not limited in any way to those compositions set forth in said copending applications. For example, the high acid ionomer resins recently developed by Spalding & Evenflo Companies, Inc., the assignee of the present invention, and disclosed in U.S. Ser. No. 07/901,680, filed Jun. 19, 1992, incorporated herein by reference, may also be utilized to produce the inner layer of the multi-layer cover used in the present invention.

The high acid ionomers which may be suitable for use in formulating the inner layer compositions of the subject invention are ionic copolymers which are the metal, i.e., sodium, zinc, magnesium, etc., salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (i.e., iso- or n-butylacrylate, etc.) can also be included to produce a softer terpolymer. The carboxylic acid groups of the copolymer are partially neutralized (i.e., approximately 10–75%, preferably 30–70%) by the metal ions. Each of the high acid ionomer resins which may be included in the inner layer cover compositions of the invention contains greater than about 16% by weight of a carboxylic acid, preferably from about 17% to about 25% by weight of a carboxylic acid, and more preferably from about 18.5% to about 21.5% by weight of a carboxylic acid.

Although the inner layer cover composition preferably includes a high acid ionomeric resin and the scope of the patent embraces all known high acid ionomeric resins falling within the parameters set forth above, only a relatively limited number of these high acid ionomeric resins have recently become commercially available.

The high acid ionomeric resins available from Exxon under the designation "Escor®" and or "lotek", are somewhat similar to the high acid ionomeric resins available under the "Surlyn®" trademark. However, since the Escor®/lotek ionomeric resins are sodium or zinc salts of poly (ethylene-acrylic acid) and the "Surlyn®" resins are zinc, sodium, magnesium, etc. salts of poly(ethylene-methacrylic acid), distinct differences in properties exist.

Examples of the high acid methacrylic acid based ionomers found suitable for use in accordance with this invention include Surlyn® AD-8422 (sodium cation), Surlyn® 8162 (zinc cation), Surlyn® SEP-503-1 (zinc cation), and Surlyn® SEP-503-2 (magnesium cation). According to DuPont, all of these ionomers contain from about 18.5 to about 21.5% by weight methacrylic acid.

More particularly, Surlyn® AD-8422 is currently commercially available from DuPont in a number of different grades (i.e., AD-8422-2, AD-8422-3, AD8422-5, etc.) based upon differences in melt index. According to DuPont, Surlyn® AD-8422 offers the following general properties when compared to Surlyn®8920, the stiffest, hardest of all on the low acid grades (referred to as "hard" ionomers in U.S. Pat. No. 4,884,814) as shown in Table 2:

TABLE 2

| | LOW ACID (15 wt % Acid) | HIGH ACID (>20 wt % Acid) | |
|---|---|---|---|
| | SURLYN ® 8920 | SURLYN ® 8422-2 | SURLYN ® 8422-3 |
| IONOMER | | | |
| Cation | Na | Na | Na |
| Melt Index | 1.2 | 2.8 | 1.0 |
| Sodium, Wt % | 2.3 | 1.9 | 2.4 |
| Base Resin MI | 60 | 60 | 60 |
| MP[1], ° C. | 88 | 86 | 85 |
| FP[1], ° C. | 47 | 48.5 | 45 |
| COMPRESSION MOLDING[2] | | | |
| Tensile Break, psi | 4350 | 4190 | 5330 |
| Yield, psi | 2880 | 3670 | 3590 |
| Elongation, % | 315 | 263 | 289 |
| Flex Mod, K psi | 53.2 | 76.4 | 88.3 |
| Shore D hardness | 66 | 67 | 68 |

[1]DSC second heat, 10° C./min heating rate.
[2]Samples compression molded at 150° C. annealed 24 hours at 60° C. 8422-2, -3 were homogenized at 190° C. before molding.

In comparing Surlyn® 8920 to Surlyn® 8422-2 and Surlyn® 8422-3, it is noted that the high acid Surlyn® 8422-2 and 8422-3 ionomers have a higher tensile yield, lower elongation, slightly higher Shore D hardness and much higher flexural modulus. Surlyn® 8920 contains 15 weight percent methacrylic acid and is 59% neutralized with sodium.

In addition, Surlyn® SEP-503-1 (zinc cation) and Surlyn® SEP-503-2 (magnesium cation) are high acid zinc and magnesium versions of the Surlyn® AD 8422 high acid ionomers. When compared to the Surlyn® AD 8422 high acid ionomers, the Surlyn SEP-503-1 and SEP-503-2 ionomers can be defined as follows in Table 3:

TABLE 3

| Surlyn ® Ionomer | Ion | Melt Index | Neutralization % |
|---|---|---|---|
| AD 8422-3 | Na | 1.0 | 45 |
| SEP 503-1 | Zn | 0.8 | 38 |
| SEP 503-2 | Mg | 1.8 | 43 |

Furthermore, Surlyn® 8162 is a zinc cation ionomer resin containing approximately 20% by weight (i.e. 18.5–21.5% weight) methacrylic acid copolymer that has been 30–70% neutralized. Surlyn® 8162 is currently commercially available from DuPont.

Examples of the high acid acrylic acid based ionomers suitable for use in the present invention also include the Escor® or lotek high acid ethylene acrylic acid ionomers produced by Exxon. In this regard, Escor® or lotek 959 is a sodium ion neutralized ethylene-acrylic neutralized ethylene-acrylic acid copolymer. According to Exxon, loteks 959 and 960 contain from about 19.0 to about 21.0% by weight acrylic acid with approximately 30 to about 70 percent of the acid groups neutralized with sodium and zinc ions, respectively. The physical properties of these high acid acrylic acid based ionomers are as follows in Table 4:

TABLE 4

| PROPERTY | ESCOR ® (IOTEK) 959 | ESCOR ® (IOTEK) 960 |
|---|---|---|
| Melt Index, g/10 min | 2.0 | 1.8 |
| Cation | Sodium | Zinc |
| Melting Point, ° F. | 172 | 174 |
| Vicat Softening Point, ° F. | 130 | 131 |
| Tensile @ Break, psi | 4600 | 3500 |
| Elongation @ Break, % | 325 | 430 |
| Hardness, Shore D | 66 | 57 |
| Flexural Modulus, psi | 66,000 | 27,000 |

Furthermore, as a result of the development by the inventors of a number of new high acid ionomers neutralized to various extents by several different types of metal cations, such as by manganese, lithium, potassium, calcium and nickel cations, several new high acid ionomers and/or high acid ionomer blends besides sodium, zinc and magnesium high acid ionomers or ionomer blends are now available for golf ball cover production. It has been found that these new cation neutralized high acid ionomer blends produce inner cover layer compositions exhibiting enhanced hardness and resilience due to synergies which occur during processing. Consequently, the metal cation neutralized high acid ionomer resins recently produced can be blended to produce substantially harder inner cover layers for multi-layered golf balls having higher C.O.R.'s than those produced by the low acid ionomer inner cover compositions presently commercially available.

More particularly, several new metal cation neutralized high acid ionomer resins have been produced by the inventor by neutralizing, to various extents, high acid copolymers of an alpha-olefin and an alpha, beta-unsaturated carboxylic acid with a wide variety of different metal cation salts. This discovery is the subject matter of U.S. application Ser. No. 901,680, incorporated herein by reference. It has been found that numerous new metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (i.e. from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic add being preferred.

The softening comonomer that can be optionally included in the invention may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 30 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

Along these lines, examples of the preferred high acid base copolymers which fulfill the criteria set forth above, are a series of ethylene-acrylic copolymers which are commercially available from The Dow Chemical Company, Midland, Mich., under the "Primacor" designation. These high acid base copolymers exhibit the typical properties set forth below in Table 5.

TABLE 5

Typical Properties of Primacor Ethylene-Acrylic Acid Copolymers

| GRADE ASTM | PERCENT ACID | DENSITY, glcc D-792 | MELT INDEX, g/10 min D-1238 | TENSILE YD. ST (psi) D-638 | FLEXURAL MODULUS (psi) D-790 | VICAT SOFT PT (° C.) D-1525 | SHORE D HARDNESS D-2240 |
|---|---|---|---|---|---|---|---|
| 5980 | 20.0 | 0.968 | 300.0 | — | 4800 | 43 | 50 |
| 5990 | 20.0 | 0.955 | 1300.0 | 650 | 2600 | 40 | 42 |
| 5990 | 20.0 | 0.955 | 1300.0 | 650 | 3200 | 40 | 42 |
| 5981 | 20.0 | 0.960 | 300.0 | 900 | 3200 | 46 | 48 |
| 5981 | 20.0 | 0.960 | 300.0 | 900 | 3200 | 46 | 48 |
| 5983 | 20.0 | 0.958 | 500.0 | 850 | 3100 | 44 | 45 |
| 5991 | 20.0 | 0.953 | 2600.0 | 635 | 2600 | 38 | 40 |

The Melt Index values are obtained according to ASTM D-1238, at 190° C.

Due to the high molecular weight of the Primacor 5981 grade of the ethylene-acrylic acid copolymer, this copolymer is the more preferred grade utilized in the invention.

The metal cation salts utilized in the invention are those salts which provide the metal cations capable of neutralizing, to various extents, the carboxylic acid groups of the high acid copolymer. These include acetate, oxide or hydroxide salts of lithium, calcium, zinc, sodium, potassium, nickel, magnesium, and manganese.

Examples of such lithium ion sources are lithium hydroxide monohydrate, lithium hydroxide, lithium oxide and lithium acetate. Sources for the calcium ion include calcium hydroxide, calcium acetate and calcium oxide. Suitable zinc ion sources are zinc acetate dihydrate and zinc acetate, a blend of zinc oxide and acetic acid. Examples of sodium ion sources are sodium hydroxide and sodium acetate. Sources for the potassium ion include potassium hydroxide and potassium acetate. Suitable nickel ion sources are nickel acetate, nickel oxide and nickel hydroxide. Sources of magnesium include magnesium oxide, magnesium hydroxide, magnesium acetate. Sources of manganese include manganese acetate and manganese oxide.

The new metal cation neutralized high acid ionomer resins are produced by reacting the high acid base copolymer with various amounts of the metal cation salts above the crystalline melting point of the copolymer, such as at a temperature from about 200° F. to about 500° F., preferably from about 250° F. to about 350° F. under high shear conditions at a pressure of from about 10 psi to 10,000 psi. Other well known blending techniques may also be used. The amount of metal cation salt utilized to produce the new metal cation neutralized high acid based ionomer resins is the quantity which provides a sufficient amount of the metal cations to neutralize the desired percentage of the carboxylic acid groups in the high acid copolymer. The extent of neutralization is generally from about 10% to about 90%.

As indicated below in Table 6 and more specifically in Example 1 in U.S. application Ser. No. 901,680, a number of new types of metal cation neutralized high acid ionomers can be obtained from the above indicated process. These include new high acid ionomer resins neutralized to various extents with manganese, lithium, potassium, calcium and nickel cations. In addition, when a high acid ethylene/acrylic acid copolymer is utilized as the base copolymer component of the invention and this component is subsequently neutralized to various extents with the metal cation salts producing acrylic acid based high acid ionomer resins neutralized with cations such as sodium, potassium, lithium, zinc, magnesium, manganese, calcium and nickel, several new cation neutralized acrylic acid based high acid ionomer resins are produced.

TABLE 6

| Formulation No. | Wt-% Cation Salt | Wt-% Neutralization | Melt Index | C.O.R. | Shore D Hardness |
|---|---|---|---|---|---|
| 1(NaOH) | 6.98 | 67.5 | 0.9 | .804 | 71 |
| 2(NaOH) | 5.66 | 54.0 | 2.4 | .808 | 73 |
| 3(NaOH) | 3.84 | 35.9 | 12.2 | .812 | 69 |
| 4(NaOH) | 2.91 | 27.0 | 17.5 | .812 | (brittle) |
| 5(MnAc) | 19.6 | 71.7 | 7.5 | .809 | 73 |
| 6(MnAc) | 23.1 | 88.3 | 3.5 | .814 | 77 |
| 7(MnAc) | 15.3 | 53.0 | 7.5 | .810 | 72 |
| 8(MnAc) | 26.5 | 106 | 0.7 | .813 | (brittle) |
| 9(LiOH) | 4.54 | 71.3 | 0.6 | .810 | 74 |
| 10(LiOH) | 3.38 | 52.5 | 4.2 | .818 | 72 |
| 11(LiOH) | 2.34 | 35.9 | 18.6 | .815 | 72 |
| 12(KOH) | 5.30 | 36.0 | 19.3 | Broke | 70 |
| 13(KOH) | 8.26 | 57.9 | 7.18 | .804 | 70 |
| 14(KOH) | 10.7 | 77.0 | 4.3 | .801 | 67 |
| 15(ZnAc) | 17.9 | 71.5 | 0.2 | .806 | 71 |
| 16(ZnAc) | 13.9 | 53.0 | 0.9 | .797 | 69 |
| 17(ZnAc) | 9.91 | 36.1 | 3.4 | .793 | 67 |
| 18(MgAc) | 17.4 | 70.7 | 2.8 | .814 | 74 |
| 19(MgAc) | 20.6 | 87.1 | 1.5 | .815 | 76 |
| 20(MgAc) | 13.8 | 53.8 | 4.1 | .814 | 74 |
| 21(CaAc) | 13.2 | 69.2 | 1.1 | .813 | 74 |
| 22(CaAc) | 7.12 | 34.9 | 10.1 | .808 | 70 |

TABLE 6-continued

| Formulation No. | Wt-% Cation Salt | Wt-% Neutralization | Melt Index | C.O.R. | Shore D Hardness |
|---|---|---|---|---|---|
| 23(MgO) | 2.91 | 53.5 | 2.5 | .813 | |
| 24(MgO) | 3.85 | 71.5 | 2.8 | .808 | |
| 25(MgO) | 4.76 | 89.3 | 1.1 | .809 | |
| 26(MgO) | 1.96 | 35.7 | 7.5 | .815 | |
| 27(NiAc) | 13.04 | 61.1 | 0.2 | .802 | 71 |
| 28(NiAc) | 10.71 | 48.9 | 0.5 | .799 | 72 |
| 29(NiAc) | 8.26 | 36.7 | 1.8 | .796 | 69 |
| 30(NiAc) | 5.66 | 24.4 | 7.5 | .786 | 64 |

Controls:
50/50 Blend of loteks 8000/7030 C.O.R. = .810/65 Shore D Hardness
DuPont High Acid Surlyn ® 8422 (Na) C.O.R. = .811/70 Shore D Hardness
DuPont High Acid Surlyn ® 8162 (Zn) C.O.R. = .807/65 Shore D Hardness
Exxon High Acid lotek EX-960 (Zn) C.O.R. = .796/65 Shore D Hardness
Control for Formulations 23–26 is 50/50 lotek 8000/7030, C.O.R. = .814, Formulation 26 C.O.R. was normalized to that control accordingly
Control for Formulation Nos. 27–30 is 50/50 lotek 8000/7030, C.O.R. = .807

When compared to low acid versions of similar cation neutralized ionomer resins, the new metal cation neutralized high acid ionomer resins exhibit enhanced hardness, modulus and resilience characteristics. These are properties that are particularly desirable in a number of thermoplastic fields, including the field of golf ball manufacturing.

When utilized in the construction of the inner layer of a multi-layered golf ball, it has been found that the new acrylic acid based high acid ionomers extend the range of hardness beyond that previously obtainable while maintaining the beneficial properties (i.e. durability, click, feel, etc.) of the softer low acid ionomer covered balls, such as balls produced utilizing the low acid ionomers disclosed in U.S. Pat. Nos. 4,884,814 and 4,911,451.

Moreover, as a result of the development of a number of new acrylic acid based high acid ionomer resins neutralized to various extents by several different types of metal cations, such as manganese, lithium, potassium, calcium and nickel cations, several new ionomers or ionomer blends are now available for production of an inner cover layer of a multi-layered golf ball. By using these high acid ionomer resins, harder, stiffer inner cover layers having higher C.O.R.s, and thus longer distance, can be obtained.

More preferably, it has been found that when two or more of the above-indicated high acid ionomers, particularly blends of sodium and zinc high acid ionomers, are processed to produce the covers of multi-layered golf balls, (i.e., the inner cover layer herein) the resulting golf balls will travel further than previously known multi-layered golf balls produced with low acid ionomer resin covers due to the balls' enhanced coefficient of restitution values.

For example, the multi-layer golf ball taught in U.S. Pat. No. 4,650,193 does not incorporate a high acid ionomeric resin in the inner cover layer. The coefficient of restitution of the golf ball having an inner layer taught by the '193 patent is generally substantially lower than the coefficient of restitution of the compositions described herein. In addition, the multi-layered ball disclosed in the '193 patent suffers substantially in durability in comparison with the present invention.

With respect to the outer layer of the multi-layered cover of the present invention, the outer cover layer is comparatively softer than the high acid ionomer based inner layer. The softness provides for the feel and playability characteristics typically associated with balata or balata-blend balls. The outer layer or ply is comprised of a relatively soft, low modulus (about 1,000 psi to about 10,000 psi) and low acid (less than 16 weight percent acid) ionomer, ionomer blend or a non-ionomeric thermoplastic elastomer such as, but not limited to, a polyurethane, a polyester elastomer such as that marketed by DuPont under the trademark Hytrel®, or a polyester amide such as that marketed by Elf Atochem S. A. under the trademark Pebax®. The outer layer is fairly thin (i.e. from about 0.010 to about 0.050 in thickness, more desirably 0.03 inches in thickness for a 1.680 inch ball), but thick enough to achieve desired playability characteristics while minimizing expense.

Preferably, the outer layer includes a blend of hard and soft (low acid) ionomer resins such as those described in U.S. Pat. Nos. 4,884,814 and 5,120,791, both incorporated herein by reference. Specifically, a desirable material for use in molding the outer layer comprises a blend of a high modulus (hard) ionomer with a low modulus (soft) ionomer to form a base ionomer mixture. A high modulus ionomer herein is one which measures from about 15,000 to about 70,000 psi as measured in accordance with ASTM method D-790. The hardness may be defined as at least 50 on the Shore D scale as measured in accordance with ASTM method D-2240.

A low modulus ionomer suitable for use in the outer layer blend has a flexural modulus measuring from about 1,000 to about 10,000 psi, with a hardness of about 20 to about 40 on the Shore D scale.

The hard ionomer resins utilized to produce the outer cover layer composition hard/soft blends include ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

The hard ionomeric resins are likely copolymers of ethylene and either acrylic and/or methacrylic acid, with copolymers of ethylene and acrylic acid being the most preferred. Two or more types of hard ionomeric resins may be blended into the outer cover layer compositions in order to produce the desired properties of the resulting golf balls.

As discussed earlier herein, the hard ionomeric resins introduced under the designation Escor® and sold under the designation "lotek" are somewhat similar to the hard ionomeric resins sold under the Surlyn® trademark. However, since the "lotek" ionomeric resins are sodium or zinc salts of poly(ethylene-acrylic acid) and the Surlyn® resins are zinc or sodium salts of poly(ethylene-methacrylic acid) some distinct differences in properties exist. As more specifically indicated in the data set forth below, the hard "lotek" resins (i.e., the acrylic acid based hard ionomer resins) are the more preferred hard resins for use in formulating the outer layer blends for use in the present invention. In addition, various blends of "lotek" and Surlyn® hard ionomeric resins, as well as other available ionomeric resins, may be utilized in the present invention in a similar manner.

Examples of commercially available hard ionomeric resins which may be used in the present invention in formulating the outer cover blends include the hard sodium ionic copolymer sold under the trademark Surlyn®8940 and the hard zinc ionic copolymer sold under the trademark Surlyn®9910. Surlyn®8940 is a copolymer of ethylene with methacrylic acid and about 15 weight percent acid which is about 29 percent neutralized with sodium ions. This resin has an average melt flow index of about 2.8. Surlyn®9910 is a copolymer of ethylene and methacrylic acid with about 15 weight percent acid which is about 58 percent neutralized with zinc ions. The average melt flow index of Surlyn®9910 is about 0.7. The typical properties of Surlyn®9910 and 8940 are set forth below in Table 7:

TABLE 7

Typical Properties of Commercially Available Hard Surlyn ® Resins Suitable for Use in the Outer Layer Blends of the Present Invention

| | ASTM D | 8940 | 9910 | 8920 | 8528 | 9970 | 9730 |
|---|---|---|---|---|---|---|---|
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, | D-638 | (4.8) | (3.6) | (5.4) | (4.2) | (3.2) | (4.1) |
| (kpsi), MPa | | 33.1 | 24.8 | 37.2 | 29.0 | 22.0 | 28.0 |
| Elongation, % | D-638 | 470 | 290 | 350 | 450 | 460 | 460 |
| Flexural Modulus, | D-790 | (51) | (48) | (55) | (32) | (28) | (30) |
| (kpsi) MPa | | 350 | 330 | 380 | 220 | 190 | 210 |
| Tensile Impact (23° C.) | D-1822S | 1020 | 1020 | 865 | 1160 | 760 | 1240 |
| KJ/m$_2$ (ft.-lbs./in$^2$) | | (485) | (485) | (410) | (550) | (360) | (590) |
| Vicat Temperature, ° C. | D-1525 | 63 | 62 | 58 | 73 | 61 | 73 |

Examples of the more pertinent acrylic acid based hard ionomer resin suitable for use in the present outer cover composition sold under the "lotek" tradename by the Exxon Corporation include lotek 4000, lotek 4010, lotek 8000, lotek 8020 and lotek 8030. The typical properties of these and other lotek hard ionomers suited for use in formulating the outer layer cover composition are set forth below in Table 8:

TABLE 8

Typical Properties of Iotek Ionomers

| | ASTM Method | Units | 4000 | 4010 | 8000 | 8020 | 8030 |
|---|---|---|---|---|---|---|---|
| Resin Properties | | | | | | | |
| Cation type | | | zinc | zinc | sodium | sodium | sodium |
| Melt index | D-1238 | g/10 min. | 2.5 | 1.5 | 0.8 | 1.6 | 2.8 |
| Density | D-1505 | $kg/m^3$ | 963 | 963 | 954 | 960 | 960 |
| Melting Point | D-3417 | ° C. | 90 | 90 | 90 | 87.5 | 87.5 |
| Crystallization Point | D-3417 | ° C. | 62 | 64 | 56 | 53 | 55 |
| Vicat Softening Point | D-1525 | ° C. | 62 | 63 | 61 | 64 | 67 |
| % Weight Acrylic Acid | | | 16 | | 11 | | |
| % of Acid Groups cation neutralized | | | 30 | | 40 | | |
| Plaque Properties (3 mm thick, compression molded) | | | | | | | |
| Tensile at break | D-638 | MPa | 24 | 26 | 36 | 31.5 | 28 |
| Yield point | D-638 | MPa | none | none | 21 | 21 | 23 |
| Elongation at break | D-638 | % | 395 | 420 | 350 | 410 | 395 |
| 1% Secant modulus | D-638 | MPa | 160 | 160 | 300 | 350 | 390 |
| Shore Hardness D | D-2240 | — | 55 | 55 | 61 | 58 | 59 |
| Film Properties (50 micron film 2.2:1 Blow-up ratio) | | | | | | | |
| Tensile at Break | | | | | | | |
| MD | D-882 | MPa | 41 | 39 | 42 | 52 | 47.4 |
| TD | D-882 | MPa | 37 | 38 | 38 | 38 | 40.5 |
| Yield point | | | | | | | |
| MD | D-882 | MPa | 15 | 17 | 17 | 23 | 21.6 |
| TD | D-882 | Mpa | 14 | 15 | 15 | 21 | 20.7 |
| Elongation at Break | | | | | | | |
| MD | D-882 | % | 310 | 270 | 260 | 295 | 305 |
| TD | D-882 | % | 360 | 340 | 280 | 340 | 345 |
| 1% Secant modulus | | | | | | | |
| MD | D-882 | MPa | 210 | 215 | 390 | 380 | 380 |
| TD | D-882 | MPa | 200 | 225 | 380 | 350 | 345 |
| Dart Drop Impact | D-1709 | g/micron | 12.4 | 12.5 | 20.3 | | |

| | ASTM Method | Units | 7010 | 7020 | 7030 |
|---|---|---|---|---|---|
| Resin Properties | | | | | |
| Cation type | | | zinc | zinc | zinc |
| Melt Index | D-1238 | g/10 min. | 0.8 | 1.5 | 2.5 |
| Density | D-1505 | $kg/m^3$ | 960 | 960 | 960 |
| Melting Point | D-3417 | ° C. | 90 | 90 | 90 |
| Crystallization Point | D-3417 | ° C. | — | — | — |
| Vicat Softening Point | D-1525 | ° C. | 60 | 63 | 62.5 |
| % Weight Acrylic Acid | | | — | — | — |
| % of Acid Groups Cation Neutralized | | | — | — | — |
| Plaque Properties (3 mm thick, compression molded) | | | | | |
| Tensile at break | D-638 | MPa | 38 | 38 | 38 |
| Yield Point | D-638 | MPa | none | none | none |
| Elongation at break | D-638 | % | 500 | 420 | 395 |
| 1% Secant modulus | D-638 | MPa | — | — | — |
| Shore Hardness D | D-2240 | — | 57 | 55 | 55 |

Comparatively, soft ionomers are used in formulating the hard/soft blends of the outer cover composition. These ionomers include acrylic acid based soft ionomers. They are generally characterized as comprising sodium or zinc salts of a terpolymer of an olefin having from about 2 to 8 carbon atoms, acrylic acid, and an unsaturated monomer of the acrylate ester class having from 1 to 21 carbon atoms. The soft ionomer is preferably a zinc based ionomer made from an acrylic acid base polymer in an unsaturated monomer of the acrylate ester class. The soft (low modulus) ionomers have a hardness from about 20 to about 40 as measured on the Shore D scale and a flexural modulus from about 1,000 to about 10,000, as measured in accordance with ASTM method D-790.

Certain ethylene-acrylic acid based soft ionomer resins developed by the Exxon Corporation under the designation "lotek 7520" (referred to experimentally by differences in neutralization and melt indexes as LDX 195, LDX 196, LDX 218 and LDX 219) may be combined with known hard ionomers such as those indicated above to produce the outer cover. The combination produces higher C.O.R.s at equal or softer hardness, higher melt flow (which corresponds to improved, more efficient molding, i.e., fewer rejects) as well as significant cost savings versus the outer layer of multi-layer balls produced by other known hard-soft ionomer blends as a result of the lower overall raw materials costs and improved yields.

While the exact chemical composition of the resins to be sold by Exxon under the designation lotek 7520 is considered by Exxon to be confidential and proprietary information, Exxon's experimental product data sheet lists the following physical properties of the ethylene acrylic acid zinc ionomer developed by Exxon as shown in Table 9:

TABLE 9

| Property | ASTM Method | Units | Typical Value |
|---|---|---|---|
| Physical Properties of lotek 7520 | | | |
| Melt Index | D-1238 | g/10 min. | 2 |
| Density | D-1505 | $kg/m^3$ | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | MPa | 10 |
| Yield Point | D-638 | MPa | None |
| Elongation at Break | D-638 | % | 760 |
| 1% Secant Modulus | D-638 | MPa | 22 |
| Shore D Hardness | D-2240 | | 32 |
| Flexural Modulus | D-790 | MPa | 26 |
| Zwick Rebond | ISO 4862 | % | 52 |
| De Mattia Flex Resistance | D-430 | Cycles | >5000 |

In addition, test data collected by the inventors indicates that lotek 7520 resins have Shore D hardnesses of about 32 to 36 (per ASTM D-2240), melt flow indexes of 3±0.5 g/10 min (at 190° C. per ASTM D-1288), and a flexural modulus of about 2500–3500 psi (per ASTM D-790). Furthermore, testing by an independent testing laboratory by pyrolysis mass spectrometry indicates that lotek 7520 resins are generally zinc salts of a terpolymer of ethylene, acrylic acid, and methyl acrylate.

Furthermore, the inventors have found that a newly developed grade of an acrylic acid based soft ionomer available from the Exxon Corporation under the designation lotek 7510, is also effective, when combined with the hard ionomers indicated above in producing golf ball covers exhibiting higher C.O.R. values at equal or softer hardness than those produced by known hard-soft ionomer blends. In this regard, lotek 7510 has the advantages (i.e. improved flow, higher C.O.R. values at equal hardness, increased clarity, etc.) produced by the lotek 7520 resin when compared to the methacrylic acid base soft ionomers known in the art (such as the Surlyn 8625 and the Surlyn 8629 combinations disclosed in U.S. Pat. No. 4,884,814, herein incorporated by reference).

In addition, lotek 7510, when compared to lotek 7520, produces slightly higher C.O.R. valves at equal softness/hardness due to the lotek 7510's higher hardness and neutralization. Similarly, lotek 7510 produces better release properties (from the mold cavities) due to its slightly higher stiffness and lower flow rate than lotek 7520. This is important in production where the soft covered balls tend to have lower yields caused by sticking in the molds and subsequent punched pin marks from the knockouts.

According to Exxon, lotek 7510 is of similar chemical composition as lotek 7520 (i.e. a zinc salt of a terpoloymer of ethylene, acrylic acid, and methyl acrylate) but is more highly neutralized. Based upon FTIR analysis, lotek 7520 is estimated to be about 30–40 wt.-% neutralized and lotek 7510 is estimated to be about 40–60 wt.-% neutralized. The typical properties of lotek 7510 in comparison of those of lotek 7520 are set forth below in Table 10:

TABLE 10

Physical Properties of lotek 7510 in Comparison to lotek 7520

| | IOTEK 7520 | IOTEK 7510 |
|---|---|---|
| MI, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore D | 32 | 35 |

It has been determined that when hard/soft ionomer blends are used for the outer cover layer, good results are achieved when the relative combination is in a range of about 90 to about 10 percent hard ionomer and about 10 to about 90 percent soft ionomer. The results are improved by adjusting the range to about 75 to 25 percent hard ionomer and 25 to 75 percent soft ionomer. Even better results are noted at relative ranges of about 60 to 90 percent hard ionomer resin and about 40 to 60 percent soft ionomer resin.

Specific formulations which may be used in the cover composition are included in the examples set forth in U.S. Pat. Nos. 5,120,791 and 4,884,814, both of which are herein incorporated by reference. The present invention is in no way limited to those examples.

Moreover, in alternative embodiments, the outer cover layer formulation may also comprise a soft, low modulus non-ionomeric thermoplastic elastomer including a polyester polyurethane such as B. F. Goodrich Company's Estane® polyester polyurethane X-4517. According to B. F. Goodrich, Estane® X-4517 has the following properties as shown in Table 11:

TABLE 11

Properties of Estane ® X-4517

| | |
|---|---|
| Tensile | 1430 |
| 100% | 815 |
| 200% | 1024 |
| 300% | 1193 |
| Elongation | 641 |
| Youngs Modulus | 1826 |
| Hardness A/D | 88/39 |
| Bayshore Rebound | 59 |
| Solubility in Water | Insoluble |
| Melt processing temperature | >350° F. (>177° C.) |
| Specific Gravity ($H_2O$ = 1) | 1.1–1.3 |

Other soft, relatively low modulus non-ionomeric thermoplastic elastomers may also be utilized to produce the outer cover layer as long as the non-ionomeric thermoplastic elastomers produce the playability and durability characteristics desired without adversely effecting the enhanced travel distance characteristic produced by the high acid ionomer resin composition. These include, but are not limited to thermoplastic polyurethanes such as: Texin thermoplastic polyurethanes from Mobay Chemical Co. and the Pellethane thermoplastic polyurethanes from Dow Chemical Co.; Ionomer/rubber blends such as those in Spalding U.S. Pat. Nos. 4,986,545; 5,098,105 and 5,187,013, all of which are herein incorporated by reference; and, Hytrel polyester elastomers from DuPont and pebax polyesteramides from Elf Atochem S. A.

In preparing golf balls in accordance with the present invention, a hard inner cover layer is molded (by injection molding or by compression molding) about a core (preferably a solid core). A comparatively softer outer layer is molded over the inner layer.

The covered golf ball can be formed according to methods known in the art. For example, the molded core may be placed in the center of a golf ball mold and the ionomeric resin-containing cover composition injected into and retained in the space for a period of time at a mold temperature of from about 40° F. to about 120° F.

Alternatively, the cover composition may be injection molded at about 300° F. to about 450° F. into smooth-surfaced hemispherical shells, a core and two such shells placed in a dimpled golf ball mold and unified at temperatures on the order of from about 100° F. to about 200° F.

The golf ball produced is then painted (if desired) and marked, painting being effected by spraying techniques. Several preferred embodiment golf balls are illustrated in the referenced drawings.

FIG. 1 shows a cross sectional view of a first preferred embodiment golf ball 10 made in accordance with the present invention. The golf ball core includes a central portion 12 having a hardness in a range of about 50 to about 90 Shore C, and an integral surface portion 14 having a hardness in a range of about 30 to about 70 Shore C. The surface portion 14 comprises the outermost 1/32 inch to 1/4 inch of the spherical core. A cover 16 is molded over the spherical molded core.

Figure 2:
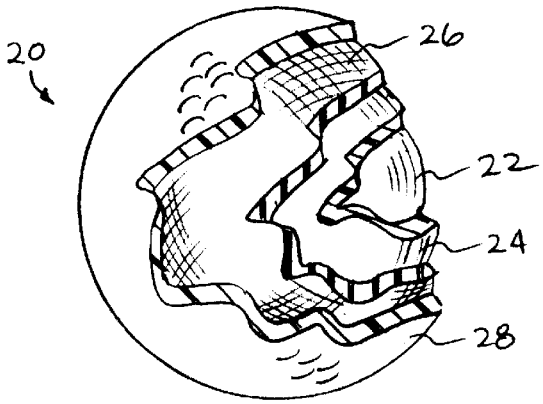
FIG. 2 is a partial sectional view of another preferred embodiment golf ball in accordance with the present invention, the view illustrating the configuration of the golf ball.

FIG. 2 illustrates another preferred embodiment golf ball 20 in accordance with the present invention. The golf ball 20 comprises a central portion 22 having a hardness of about 50 to about 90 Shore C. Disposed about the central portion 22 is a surface or skin portion 24 having a hardness in the range of from about 30 to about 70 Shore C. Surrounding the core components 22 and 24 is one or more wound layers 26. A cover 28 is molded over the spherical assembly of 26, 24, and 22.

Figure 3:
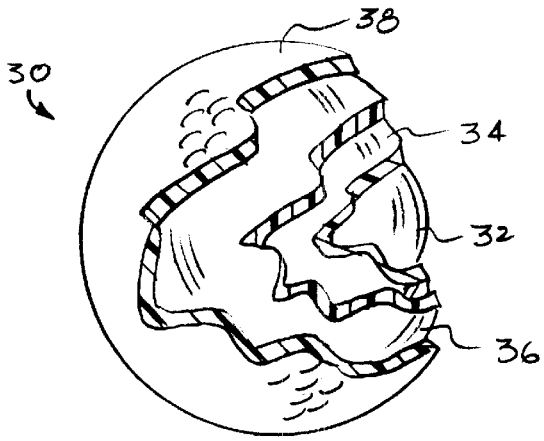
FIG. 3 is a partial sectional view of another preferred embodiment golf ball in accordance with the present invention, the view illustrating the configuration of the golf ball.

FIG. 3 illustrates yet another preferred embodiment golf ball 30 in accordance with the present invention. The golf ball 30 includes a central portion 32 having a hardness of about 50 to about 90 Shore C. Surrounding the central portion 32 is a surface or skin portion 34 having a hardness in the range of from about 30 to about 70 Shore C. Disposed about the core components 32 and 34 is a multi-layer cover, shown in FIG. 3 as comprising a first inner cover layer 36 and a second outer cover layer 38. In a particularly preferred aspect, the hardness of the central core portion is at least 20 units greater than the Shore C hardness of the core skin portion.

Figure 4:
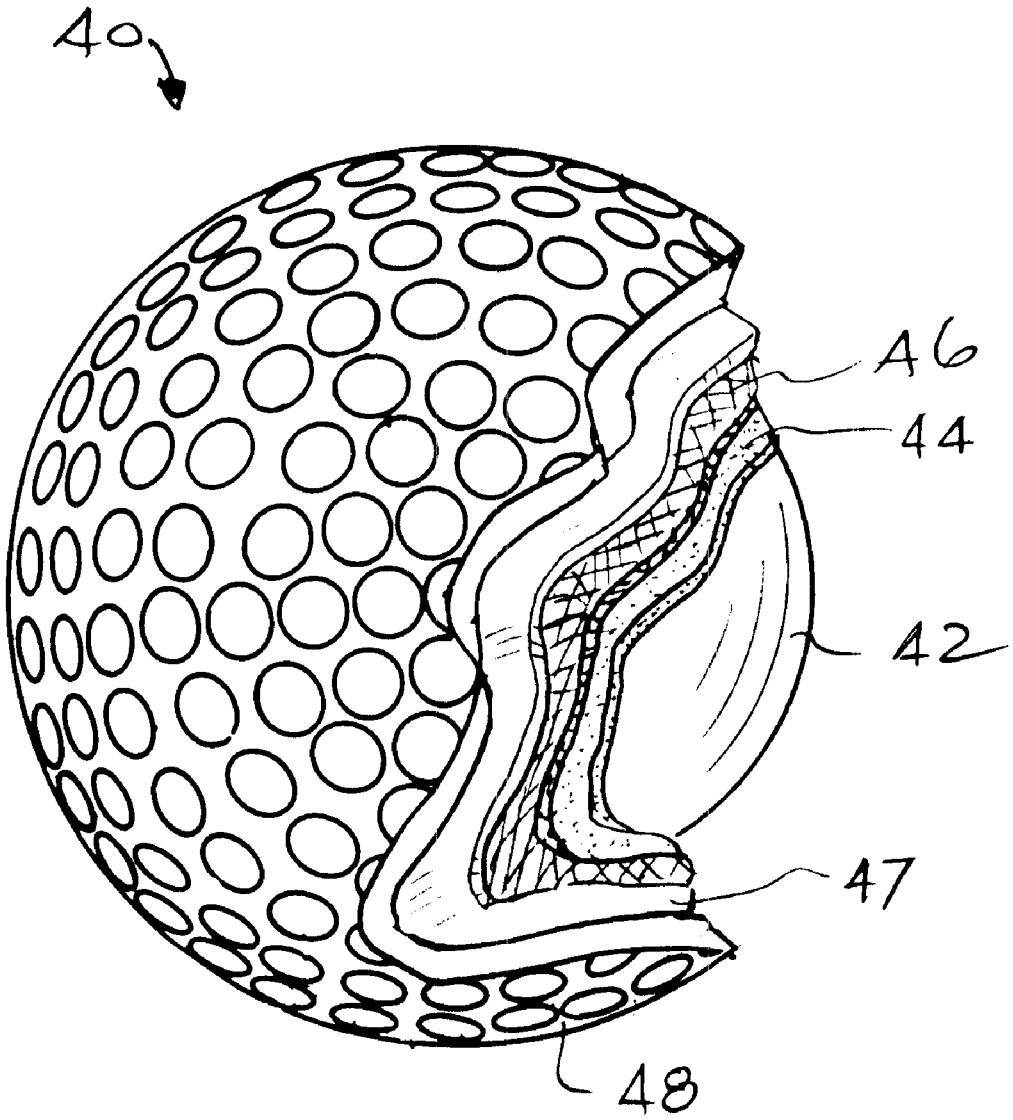
FIG. 4 is a partial sectional view of yet another preferred embodiment golf ball in accordance with the present invention, the view illustrating the configuration of the golf ball.

FIG. 4 illustrates another preferred embodiment golf ball 40 in accordance with the present invention. The golf ball 40 includes a central core portion 42 having a hardness of about 50 to about 90 Shore C. Surrounding the central portion 42 is a surface or skin portion 44 having a hardness in the range of from about 30 to about 70 Shore C. Surrounding the core components 42 and 44 is one or more wound layers 46. Disposed about the core components 42 and 44, and the wound layer 46, is a multi-layer cover that includes a first inner cover layer 47 and a second outer cover layer 48. In a most preferred aspect, the hardness of the central core portion 42 is at least about 20 units greater than the Shore C hardness of the core skin portion 44.

It will be appreciated that none of the referenced figures are to scale. These figures are schematic in nature and are provided to illustrate several preferred embodiment golf balls in accordance with the present invention.

The present invention is further illustrated by the following examples in which the parts of the specific ingredients are by weight. It is to be understood that the present invention is not limited to the examples, and various changes and modifications may be made in the invention without departing from the spirit and scope thereof.

EXAMPLES 1–9

Standard Tour Edition™ (i.e., TE) lavender slugs or preforms weighing approximately 44 grams each and having the following composition, set forth in Table 12 below, were obtained:

TABLE 12

| Component | Parts by Weight |
|---|---|
| Cariflex BR-1220 | 74.0 |
| Taktene 220 (Polybutadiene) | 26.0 |
| Zinc Oxide | 19.6 |
| T.G. Regrind | 8.8 |
| Zinc Stearate | 19.9 |
| ZDA (zinc diacrylate) | 27.1 |
| Color M.B. | 0.1 |
| Varox 230-XL (40% Peroxide) | 0.60 |
| Varox 130-XL (40% Peroxide) | 0.15 |
| | 176.25 |

Each slug had an oval shape approximately 10% larger than the center.

The exothermic reaction method described herein was conducted on the compression molded slugs. In each run, the slugs or preforms were placed into a cold 1.600 inch cavity of a four cavity lab mold or press. The four-cavity compression mold was hydraulically closed using 500 psi of ram pressure. The steam temperature was set at a predetermined steam set point and the steam was turned on for a predetermined steam time (around 15 minutes for the control, about 25–30 minutes for the remaining six slugs). The temperature overrode the set point and reached a mold temperature of higher than the set point at the end of the steam time. The steam was then turned off and cold water was applied for about 15 minutes. The mold was then opened and the cores were removed. The hardness was measured at the core center, midway from the center to the surface, and at the surface. It was found that the middle of the core is slightly softer than the midway measured hardness because of the very high exothermic temperatures which are applied. These temperatures degrade the core composition. The outer skin measured much softer. This softness is due to the cooling effect of the mold cavity. Maximum cross-linking was not achieved along the surface as a result of the low mold temperature. In contrast, the mid-way point achieves maximum cross-linking and hardness as a result of the exothermic reaction and achieves maximum cross-linking and hardness.

The steps of the exothermic reaction were repeated on six different slugs having the above composition. The steam set point and steam time varied for each trial, thus ending with varying maximum mold temperatures. Also, a control slug was prepared according to a conventional method of subjecting the slug to very high temperatures (e.g. 330° F.) for a shortened period of time (only 15 minutes). The experimental factors are identified in Table 13.

TABLE 13

| SLUG | BLOW-DOWN (MIN.) | SET POINT (° F.) | STEAM TIME (MIN.) | WATER (MIN.) | PSI (RAM) | MAXIMUM MOLD TEMPER. (° F.) |
|---|---|---|---|---|---|---|
| Control (C) | 2 | 330 | 15 | 15 | 500 | 331 |
| 1 | 2 | 230 | 25 | 15 | 500 | 280 |
| 2 | 2 | 220 | 25 | 15 | 500 | 266 |
| 3 | 2 | 210 | 25 | 15 | 500 | 262 |
| 4 | 2 | 210 | 30 | 15 | 500 | 253 |
| 5 | 2 | 200 | 30 | No cure | 500 | 215 |
| 6 | 2 | 210 | 27 | 15 | 500 | 230 |

The hardness of the cores was measured at varying diameters. The hardness in the middle of the cores, 80 Shore C, is softer than the midway point measured at 85 Shore C due to the very high exothermic temperatures degrading the core composition. The outer skin of 50 to 60 Shore C is soft due to the cooling effect of the mold cavity and does not reach maximum cross-linking as a result of the low mold temperature. The middle of the center will exceed 350° F. due to the exothermic reaction and will achieve maximum cross-linking and hardness.

Slug 3 above showed a soft ring when cut in half. It was noted, however, that ring thickness was not completely uniform. The ring was thicker (i.e. about ¼ inch thick) at one pole and thinner (i.e. about ⅛ inch thick) at the opposite pole. This inconsistency is attributable to a difference in temperature between the bottom and top steam plates. It has been determined that uniform temperature control leads to a uniform skin thickness. Also, it was noted that the hardness at the very middle of molded slug 3 measured 80 Shore C, and the measurement roughly midway from the core center to its outer diameter measured at a hardness of 85 Shore C.

Slugs 5 and 6 did not provide desirable results as temperatures did not increase sufficiently. Temperatures were reduced and steam time was increased in an attempt to obtain a soft skin on the core. As will be noted, slug 5 achieved no cure as the mold temperature increased only to 215° F. Similarly, the mold temperature of slug 6 achieved only 230° F., and its Shore C hardness was substantially lower than the others.

A seventh slug having the previously noted composition was prepared. Here, the slug was subjected to the water immersion method for developing a soft skin on a core. Slugs were immersed for two hours in water with a surfactant, in this case, Flurad FC-120. The surface moisture was blotted off and then the slug was subjected to molding with conditions likened to the control (C) above (i.e., the slugs were subjected to higher temperatures for shorter time periods). The slugs changed color on the surface to a grayish shade. The color change was only 1/32 inch deep.

The Shore C hardness was determined for all of the slugs tested above in Examples 1–7, except for slug 5. These values are set forth in Table 14:

TABLE 14

| SLUG TYPE | SHORE C |
|---|---|
| C | 85 |
| 1 | 75–80 |
| 2 | 70–75 |
| 3 | 60–70 |
| 4 | 70–75 |
| 6 | 40–50 |
| 7 | 70–75 |

The above results support the findings that the exothermic method achieves a softer skin on the slugs as compared to the control slug molded according to conventional methods.

Slugs immersed in water with a surfactant for two hours (i.e., slug 7, example 7) were molded the same as the control slugs (i.e. the control slugs were not immersed in water) and the following properties, set forth in Table 15, were determined for comparison:

TABLE 15

| | CONTROL (c) | WATER IMMERSED (EXAMPLE 7) |
|---|---|---|
| Size (inches): | 1.572 | 1.570 |
| Weight (grams): | 38.2 | 38.2 |
| Riehle Compression: | 62 | 67 |
| COR: | 0.806 | 0.805 |
| Surface Hardness (Shore C) | 85 | 70–75 |

As shown above, the core molded from a slug immersed in water was 5 points softer in compression than the control and had a Shore C surface hardness at least 5 points softer than the control. The core molded from the immersed slug when cut in half showed a change in color indicating the soft surface skin. This soft skin was approximately 1/32 inch deep.

Longer immersion times increase the thickness of the soft skin and soften the core compression further.

Next, the control slug and several of the various slug types (identified as 1, 2, 3, 4 and 7) were tested to ascertain their respective sizes, weights, Riehle compressions and coefficients of restitution. The results for the cores are tabulated in Table 16 as follows:

TABLE 16

| SLUG TYPE | SIZE (INCH) | WEIGHT (GRAM) | RIEHLE COMPRESSION | C.O.R. (ė) |
|---|---|---|---|---|
| (C) | 1.572 | 38.2 | 62 | .806 |
| 1 | 1.570 | 38.0 | 63 | .808 |
| 2 | 1.570 | 38.0 | 65 | .805 |
| 3 | 1.572 | 37.8 | 91 | .793 |
| 4 | 1.570 | 38.1 | 66 | .783 |
| 7 | 1.570 | 38.2 | 67 | .805 |

Example 8 was directed to yellow production Top-Flite® Tour Z-Balata 90 slugs comprising the following composition, set forth in Table 17. These were immersed in water and a surfactant for 67 hours:

TABLE 17

| Component | Phr |
|---|---|
| Cariflex BR-1220 | 73.0 |
| Taketene 220 | 27.0 |
| Zinc Oxide | 22.3 |
| T.G. Regrind | 10.0 |
| Zinc Stearate | 20.0 |
| ZDA | 26.0 |
| Color M.B. | 0.1 |
| 231-XL | 0.9 |
| | 179.3 |

The surfactant used in this instance was Fluorad FC-120. After immersing the slugs in water and the surfactant for 67 hours, the slugs were removed and blotted dry. They were then molded with the same conditions as the control slugs, i.e. for 15 minutes at a 330° F. steam set point.

In Example 9, the slugs were prepared as in Example 8 but air dried for 24 hours before molding. The soft skin was only about 1/16 inch deep. The following comparative results set forth in Table 18 were obtained:

TABLE 18

| SLUG | COMPRESSION | COR |
|---|---|---|
| Control (C) | 0.070 | 0.800 |
| 9 | 0.081 | 0.782 |

The control center had a Riehle compression of 0.070 inch and the center made from a slug immersed 67 hours in water had a Riehle compression of 0.081 inch. This is 11 points softer than the control due to the soft skin. In other words, the soft skin made the center compression 11 points softer. The COR, however, is 18 points slower than the control. This is expected, as balls with softer compressions normally have a lower COR than balls or cores having harder compressions.

The invention has been described with reference to the preferred embodiments. Obviously, modifications and alterations will occur to others upon reading and understanding the preceding detailed description. It is intended that the invention be construed as including all such alterations and modifications insofar as they come within the scope of the claims and the equivalents thereof.

We claim:

1. A method for producing a golf ball including a cover component, a core component having a central portion and a skin portion disposed about said central portion, said central portion being harder than said skin portion, said central portion and said skin portion being formed in-situ from the same material or different material, and a wound layer disposed between said skin portion of said core component and said cover component, said method comprising:

providing a molding apparatus having cooling and heating provisions and a chamber adapted for molding;

providing a slug of polymeric material capable of undergoing an exothermic curing reaction;

depositing said slug of polymeric material in said chamber of said molding apparatus;

curing at least a portion of said polymeric material thereby causing the temperature within the interior of said slug to increase; and cooling said chamber of said molding apparatus thereby causing the temperature at the surface of said slug to be less than said temperature within the interior of said slug;

whereby said golf ball core component having said central portion and said soft skin portion is produced.

2. The method of claim 1 wherein said temperature within the interior of said slug exceeds 350° F. during said curing operation.

3. The method of claim 1 wherein said temperature at the surface of said slug is less than 280° F. during said curing operation.

4. The method of claim 3 wherein said temperature at the surface of said slug is in the range from about 230° F. to about 280° F. during said curing operation.

5. The method of claim 1 further comprising:

heating said slug after depositing said slug in said chamber of said molding apparatus.

6. A method for producing a golf ball including a cover component, a core component having a central portion and a skin portion disposed about said central portion, said central portion being harder than said skin portion, said central portion and said skin portion being formed in-situ from the same material or different material, and a wound layer disposed between said skin portion of said core component and said cover component, method comprising:

providing a molding apparatus having heating provisions and a chamber adapted for molding;

providing a slug of curable polymeric material;

exposing said slug to water to enable said slug to absorb water;

depositing said slug exposed to the water in said chamber of said molding apparatus; and curing at least a portion of said polymeric material;

whereby said golf ball core component having said central portion and said soft skin portion is produced.

7. The method of claim 6 wherein said exposing step is performed by immersing said slug in water.

8. The method of claim 6 wherein said exposing step is performed in conjunction with exposing said slug to at least one surfactant.

9. A method for producing a golf ball including a cover component, a core component having a central portion and a skin portion disposed about said central portion, said central portion being harder than said skin portion, said central portion and said skin portion being formed in-situ from the same material or different material, and a wound layer disposed between said skin portion of said core component and said cover component, said method comprising:

providing a molding apparatus having heating provisions and a chamber adapted for molding;

providing a slug of curable polymeric material;

depositing a cross-linking retardant agent on the surface of said slug;

disposing said slug having said cross-linking retardant agent thereon in said chamber of said molding apparatus; and curing at least a portion of said polymeric material;

whereby said golf ball core component having said central portion and said soft skin portion is produced.

10. The method of claim 9 wherein said cross-linking retardant agent is selected from the group consisting of sulphur bearing accelerators, antioxidants, and combinations thereof.

11. The method of claim 10 wherein said sulphur bearing accelerators include benzothiazyl disulfide and 2-mercaptobenzothiazole.

12. The method of claim 10 wherein said antioxidants include dibetanaphthyl-p-phenylenediamine and 2, 4-bis [octylithio]methyl)-o-cresol.

* * * * *